US007520649B2

(12) United States Patent
Sie

(10) Patent No.: US 7,520,649 B2
(45) Date of Patent: Apr. 21, 2009

(54) SWITCHING DEVICE FOR SWITCHING BETWEEN LOW BEAM MODE AND HIGH BEAM MODE OF A XENON HEADLIGHT

(76) Inventor: Siou-Chou Sie, No. 239, Alley 146, Lane 509, Beitun Rd., Beitun District, Taichung City 406 (TW)

( * ) Notice: Subject to any disclaimer, the term of this patent is extended or adjusted under 35 U.S.C. 154(b) by 105 days.

(21) Appl. No.: 11/683,431

(22) Filed: Mar. 7, 2007

(65) Prior Publication Data

US 2008/0218085 A1 Sep. 11, 2008

(51) Int. Cl.
*F21S 8/10* (2006.01)

(52) U.S. Cl. ..... 362/539; 362/464; 362/507

(58) Field of Classification Search ..... 362/539, 362/464, 512, 270, 271, 276, 280, 277, 282, 362/284, 321, 322, 323, 324, 507

See application file for complete search history.

(56) References Cited

U.S. PATENT DOCUMENTS 5,899,559 A * 5/1999 Lachmayer et al. ..... 362/513

* cited by examiner

*Primary Examiner*—Sharon E Payne
(74) *Attorney, Agent, or Firm*—Banger Shia

(57) ABSTRACT

A switching device for switching between low beam mode and high beam mode of a xenon headlight, comprises an electromagnetic valve fixed on a fixing piece, two light-shield pieces pivotally coupled to the fixing piece, and moveable piece. The movable piece is moved by the electromagnetic valve and then drives the light-shield pieces to rotate to the gap of the fixing piece to obstruct the light beam of the xenon lamp tube, and thus the headlight is switched to the low beam mode. When the light-shield pieces are rotated away from the gap of the fixing piece by the movable piece, the headlight is switched to the high beam mode.

3 Claims, 10 Drawing Sheets

SWITCHING DEVICE FOR SWITCHING BETWEEN LOW BEAM MODE AND HIGH BEAM MODE OF A XENON HEADLIGHT

BACKGROUND OF THE INVENTION

1. Field of the Invention

The present invention relates to an illumination structure for a vehicle, and more particularly to a switching device for switching between low beam mode and high beam mode of a xenon headlight.

2. Description of the Prior Art

When driving a car, whether the driver's view is good or not is closely related to the driver's safety, especially driving in the dusky environment or in bad weather, such as in the morning, dusk or at night, the driver must turn on the headlight to see the front road, and to allow the oncoming vehicle to see the position of the vehicle. Therefore, the illuminance and the illumination range of the vehicle's headlight are very important, and in order to meet the abovementioned requirements, the current trend is to change the headlight to xenon lamp tube before the vehicle leaves the factory.

TW Pat. Nos 092219303 and 093218363 disclose "a switching device for switching headlight between high beam and low beam" and "an improved structure for switching headlight between high beam and low beam", these two Patents all utilize electromagnetic valve to drive the light-shield board, and the variation of the position of the light-shield board changes the illumination range of the light source, thus achieving the purpose of switching between high beam and low beam. And this is the design trend of today's vehicle headlight low and high beams switching device.

Based on the idea of using the electromagnetic valve to move the light-shield board, and changing the illumination range of the light source with the variation of the position of the light-shield board, the author of the invention designed an invention designed an innovated structure for controlling low and high beams of an xenon headlight, which is different from the two abovementioned low and light beams switching devices.

SUMMARY OF THE INVENTION

The primary objective of the present invention is to provide a switching device for switching between low beam mode and high beam mode of a xenon headlight, which comprises an electromagnetic valve fixed on a fixing piece, two light-shield pieces pivotally coupled to the fixing piece, and moveable piece. The movable piece is moved by the electromagnetic valve and then drives the light-shield pieces to rotate to the gap of the fixing piece to obstruct the light beam of the xenon lamp tube, and thus the headlight is switched to the low beam mode. When the light-shield pieces are rotated away from the gap of the fixing piece by the movable piece, the headlight is switched to the high beam mode.

DETAILED DESCRIPTION OF THE PREFERRED EMBODIMENTS

The present invention will be more clear from the following description when viewed together with the accompanying drawings, which show, for purpose of illustrations only, the preferred embodiment in accordance with the present invention.

Figure 1:
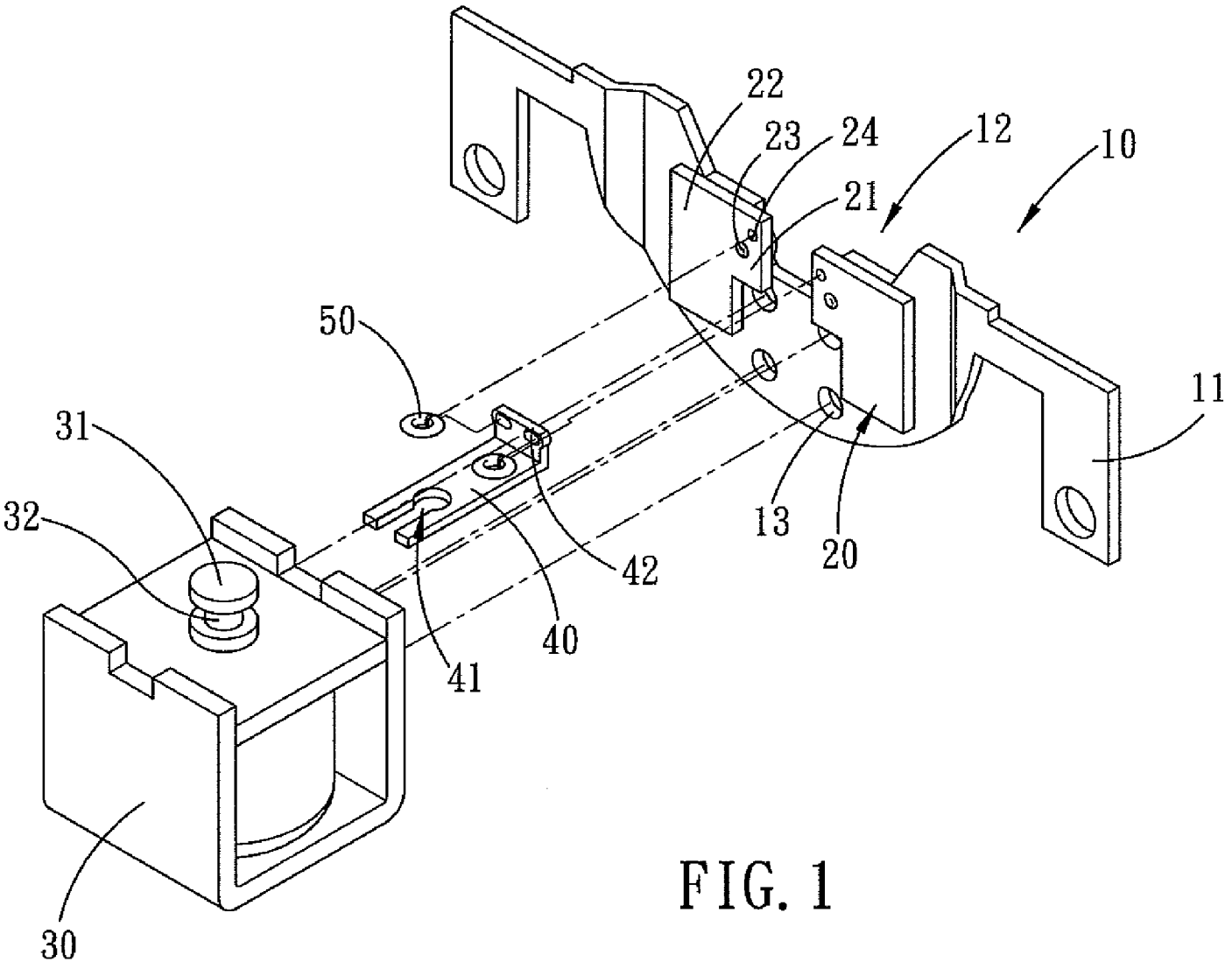
FIG. 1 is an exploded view of a switching device for switching between low beam mode and high beam mode of a xenon headlight in accordance with the present invention.

Referring to FIG. 1, a switching device for switching between low beam mode and high beam mode of a xenon headlight comprises: a fixing piece 10, two light-shield pieces 20, an electromagnetic valve 30, an movable piece 40, and two retaining rings 50.

The fixing piece 10 has a semi-circular lower half portion, at either side of the fixing piece 10 is formed a leg portion 11 extending outward therefrom, in the fixing piece 10 is further defined a stepped gap 12, and formed close to the stepped gap 12 is a plurality of connecting holes 13.

Each of the light-shield pieces 12 is a L-shaped structure with a pivotal portion 21 and a light-shield portion 22. With the pivotal portion 21, the light-shield piece 20 is pivotally connected to the fixing piece 10 by a pivot 23 and is located close to the gap 12 of the fixing piece 10. A through hole 24 is defined in the pivotal portion 21 of the light-shield piece 20 and located beside the pivot 23.

The electromagnetic valve 30 is fixed to the connecting holes 13 of the fixing piece 10 by screws and has a lifting rod 31, and formed in the middle of the rod 31 is a neck portion 32.

The movable piece 40 is L-shaped, in one end of the movable piece 40 is formed an engaging slot 41, and formed in the other end of the movable piece 40 are two horizontally arranged parallel slide slots 42. Through the engaging slot 41, the movable piece 40 is fixed to the neck portion 32 of the lifting rod 31 of the electromagnetic valve 30.

The engaging rings 50 are disposed in the slide slots 42 of the movable piece 40 and the through hole 24 of the light-shield pieces 20.

Figure 2:
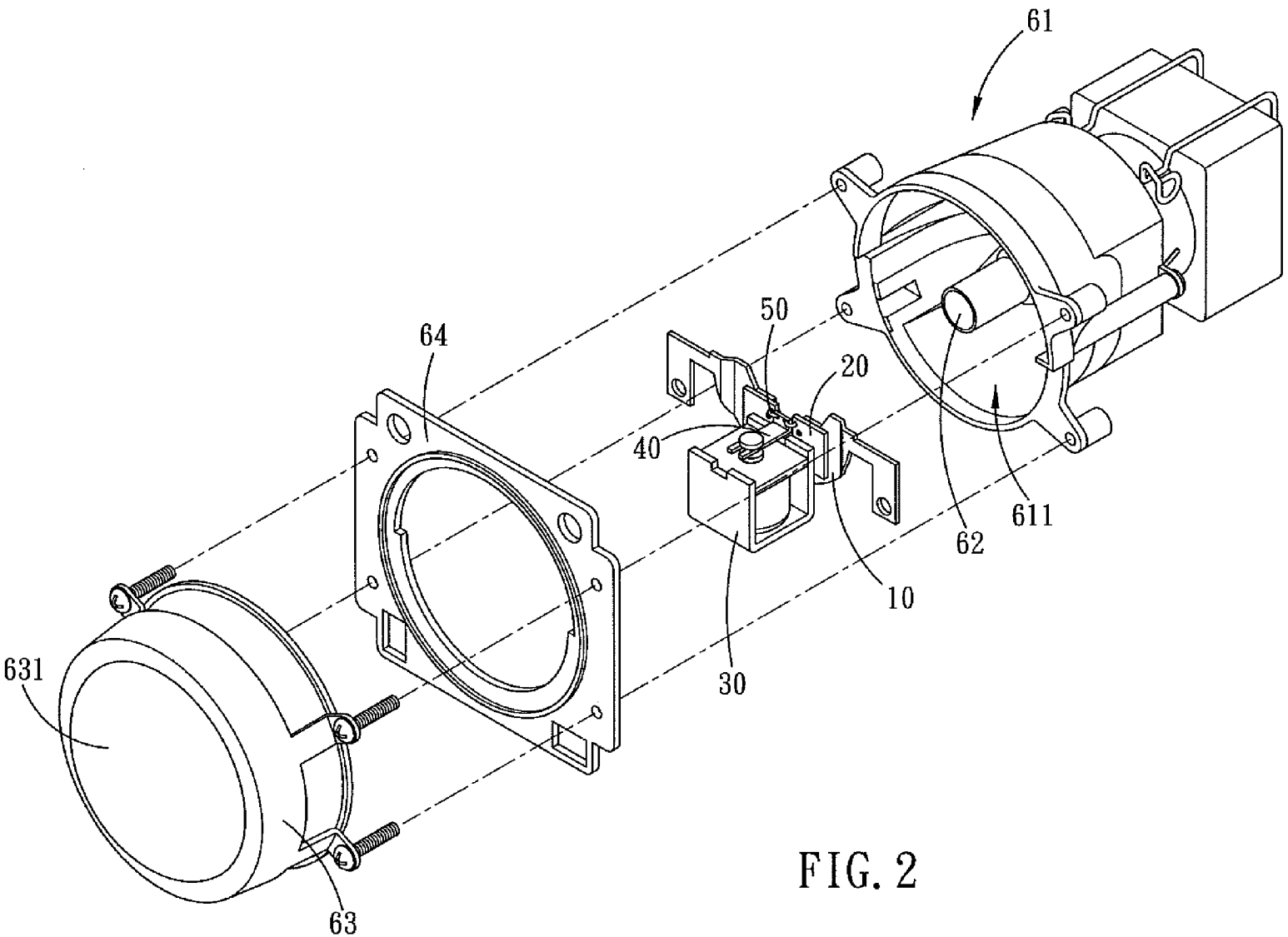
FIG. 2 is an exploded view of a xenon headlight in accordance with the present invention equipped with a low and high beam switching device.
Figure 3:
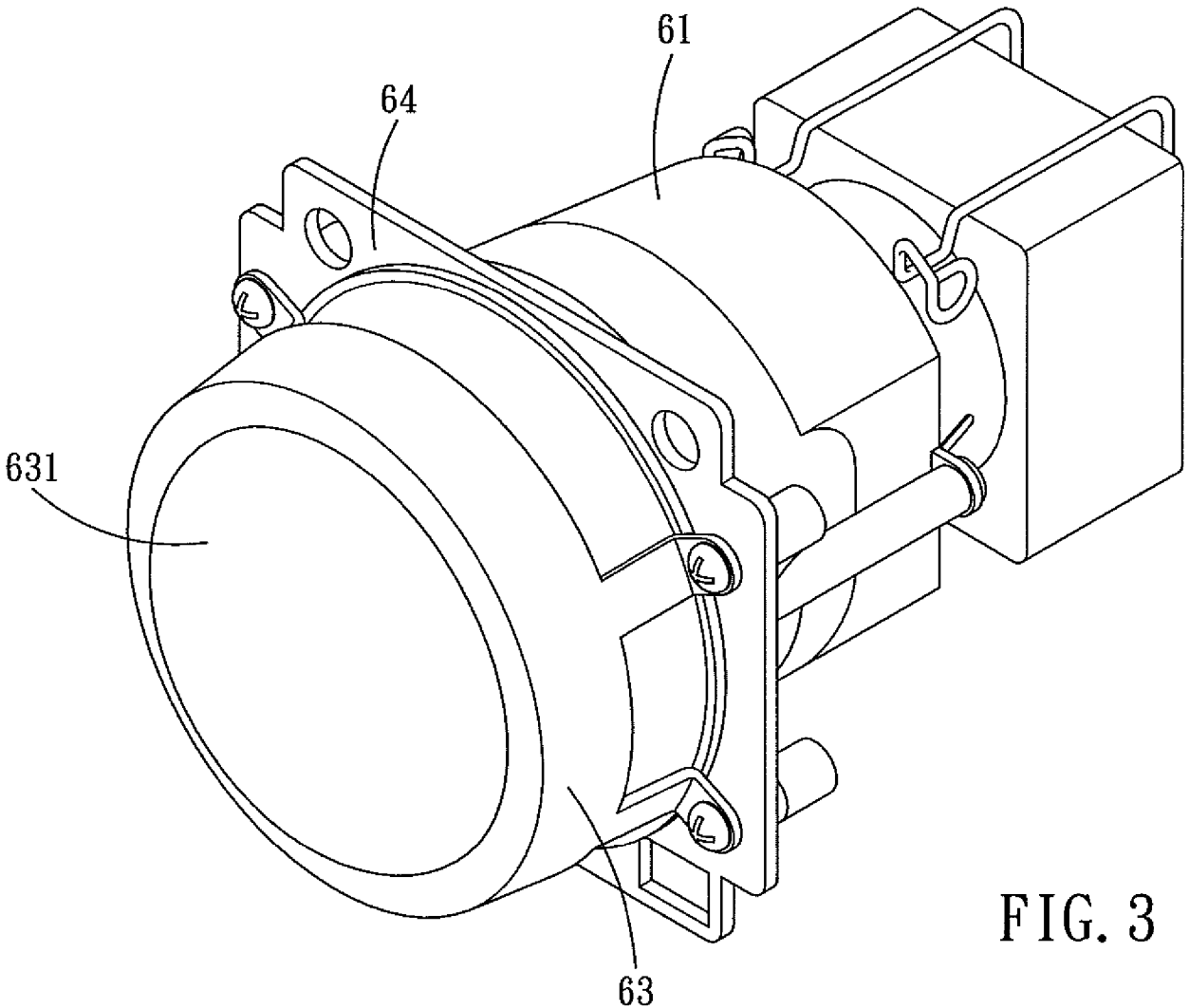
FIG. 3 is an assembly view of a xenon headlight in accordance with the present invention equipped with the low and high beam switching device.

For a better understanding of the structure of the present invention, reference should made to FIGS. 2 and 3. The switching device for switching between low beam mode and high beam mode of a xenon headlight in accordance with the present invention is located between a light holder 61 with a xenon lamp tube 62 and a transparent cover 63 and is partially disposed in the refracting recess 611 of the light holder 61. To the light holder 61 are assembled the low and high beam switching device, a frame 64, and the transparent cover 63, respectively. The transparent cover 63 is provided with a convex lens 631.

Figure 4:
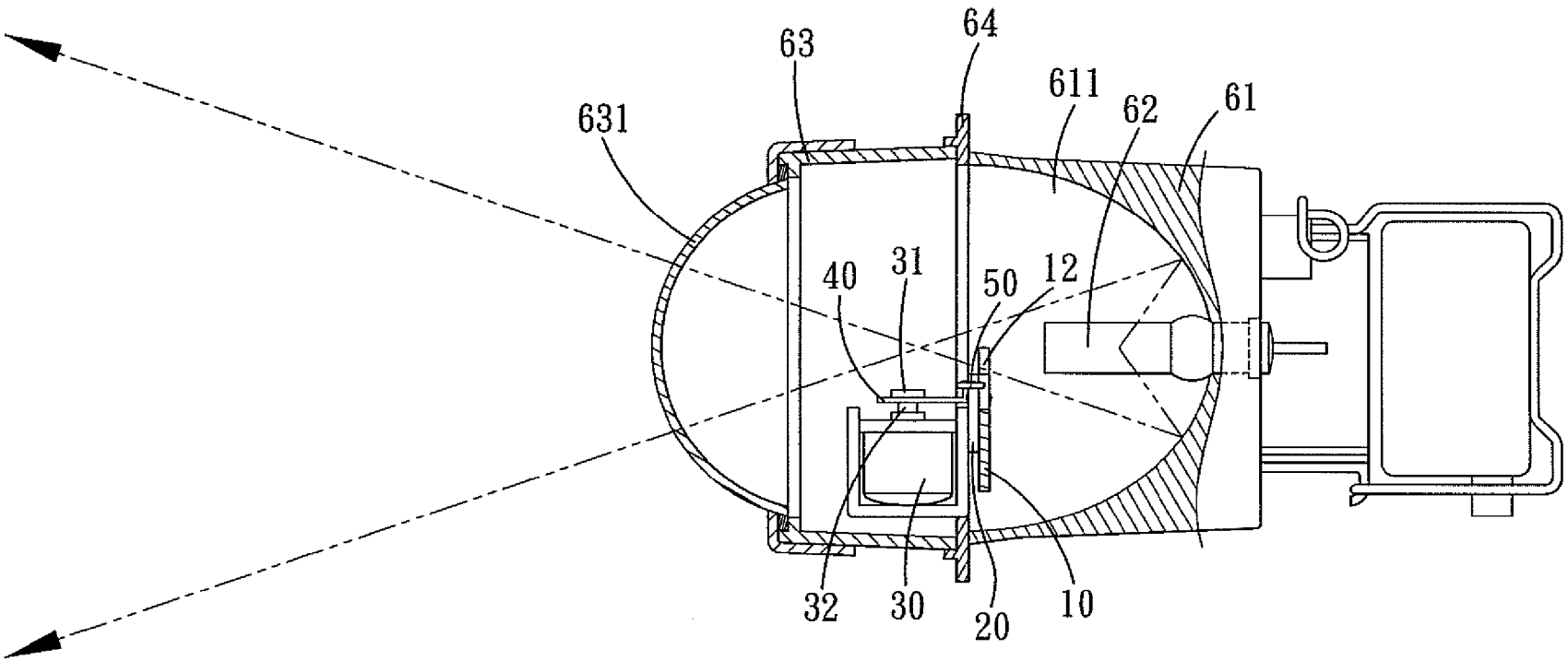
FIG. 4 is an assembly cross sectional view in accordance with the present invention of showing the high beam mode of the xenon headlight.
Figure 5:
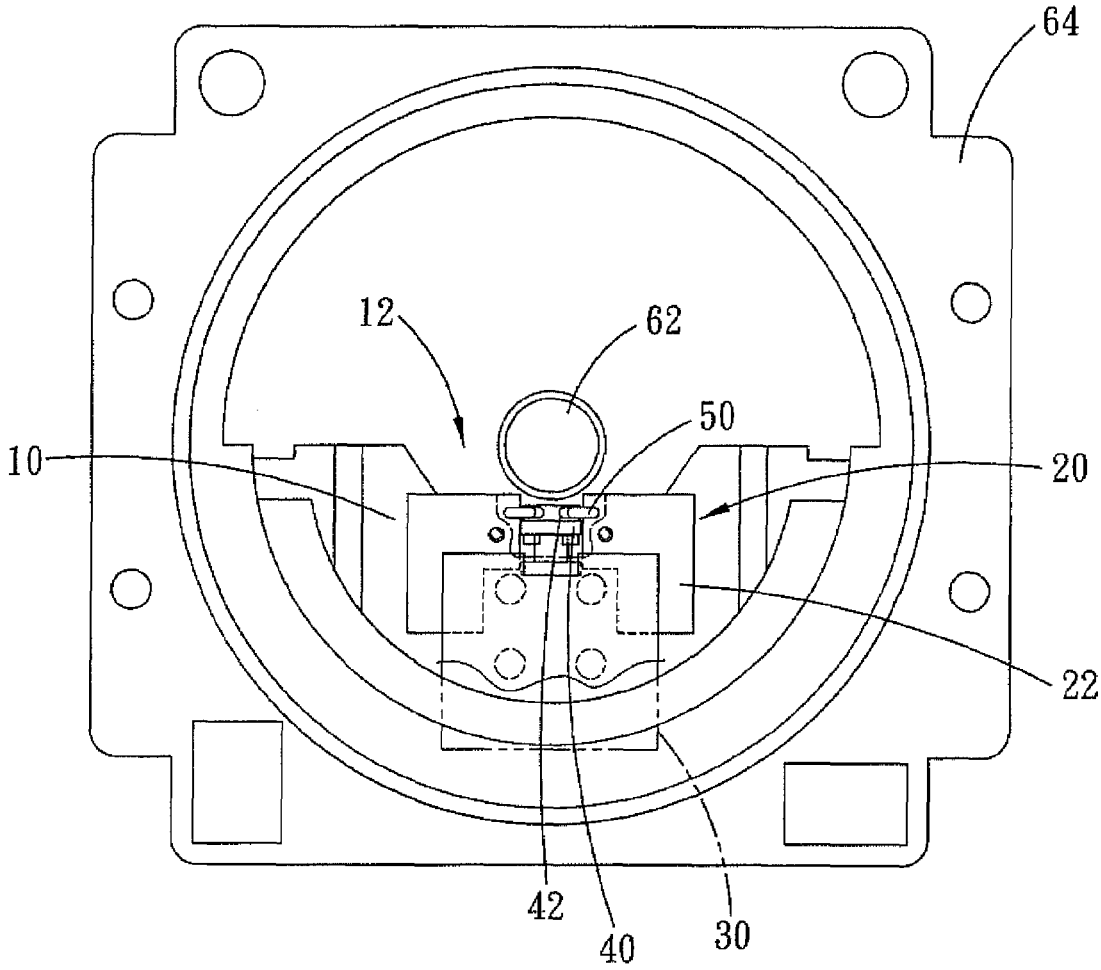
FIG. 5 is an illustrative view in accordance with the present invention of showing that the light-shield pieces do not obstruct the high beam of the xenon lamp tube.

The operation and function of the present invention are described as follows:

For the high beam mode, please refer to FIGS. 4 and 5, the gap 12 of the fixing piece 10 faces the outer end of the xenon lamp tube 62 of the light holder 61, the light of the xenon lamp tube 62 is refracted by the refracting recess 611 and then projected to the distant area. The movable piece 40 connected to the lifting rod 31 of the electromagnetic valve 30 fixed to the fixing piece 10 will move up and down along with the lifting rod 31. And meanwhile, the retaining rings 50 will drive the light-shield pieces 20 to move.

When the lifting rod 31 of the electromagnetic valve 30 moves upward, the movable piece 40 will move upward along with the lifting rod 31, and the movable piece 40 will use its slide slots 42 to push the retaining rings 50, and then the retaining rings 50 drive the light-shield pieces 20 to rotate away from the gap 12 of the fixing piece 10, and the light-shield portion 22 of the light-shield pieces 20 won't covers the gap 12. At this moment, the light-shield pieces 20 hang down, therefore, the light of the xenon lamp tube 62 won't be obstructed by the light-shield pieces 20 when it is refracted by the refracting recess 611 and projected to the distant area, and this is the high beam mode of the present invention.

Figure 6:
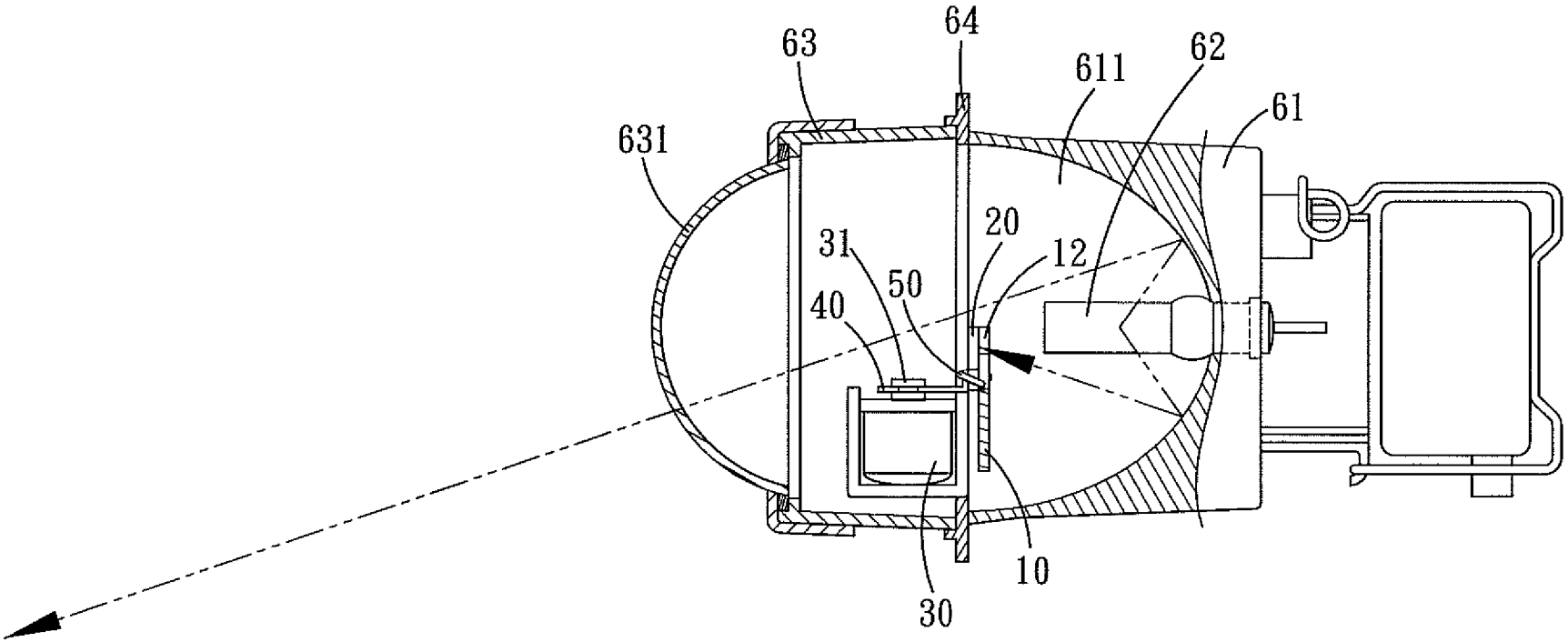
FIG. 6 is an assembly cross sectional view in accordance with the present invention of showing the low beam mode of the xenon headlight.
Figure 7:
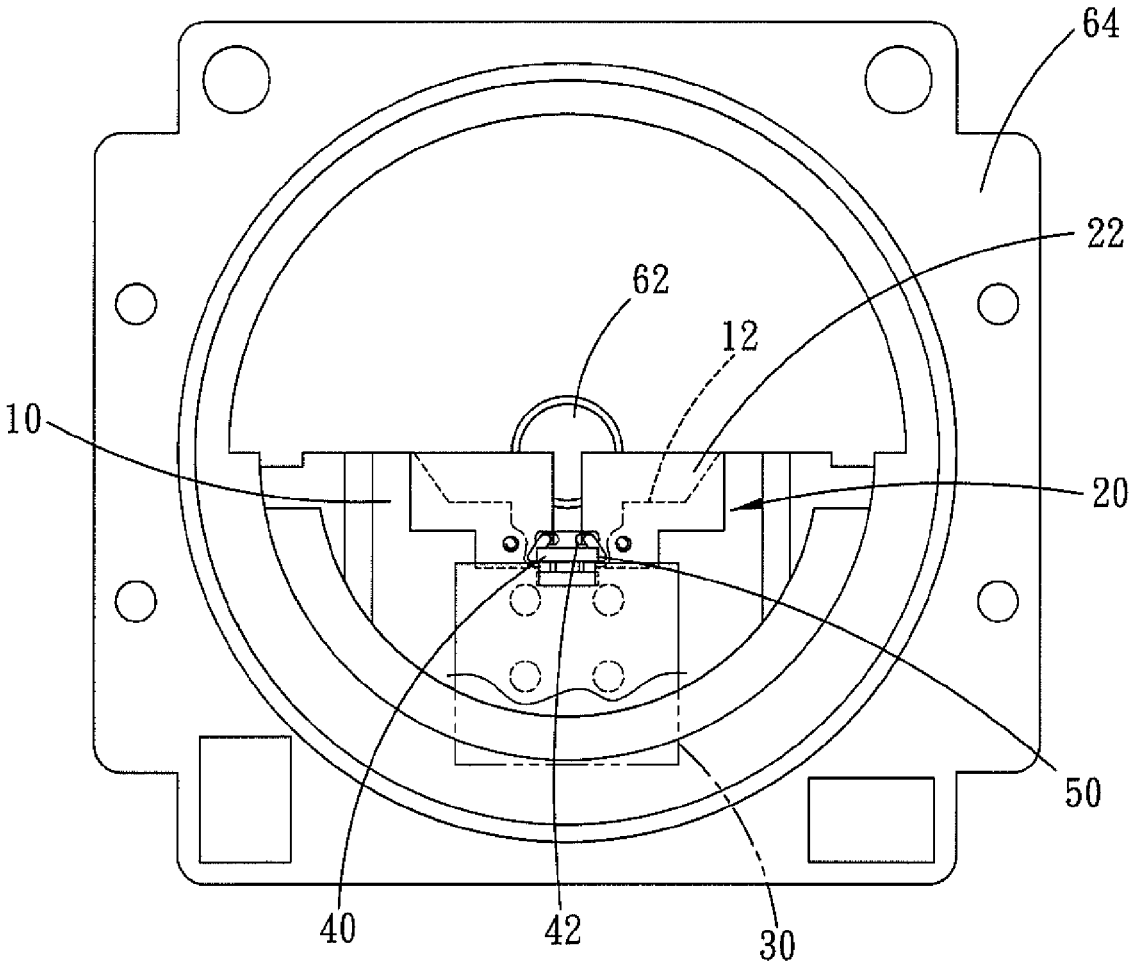
FIG. 7 is an illustrative view in accordance with the present invention of showing that the light-shield pieces obstruct the high beam of the xenon lamp tube.

When the electromagnetic valve 30 makes the lifting rod 31 move downward, as shown in FIGS. 6 and 7, the movable piece 40 will move downward along with the lifting rod 31, and the movable piece 40 will use its slide slots 42 to push the retaining rings 50, and then the retaining rings 50 will drive the light-shield pieces 20 to rotate. At this moment, the light-shield pieces 20 open horizontally, and the light-shield portion 22 is located right in the gap 12 of the fixing piece 10. Therefore, the light of the xenon lamp tube 62 will be obstructed by the light-shield pieces 20 and cannot be projected to the distant area when it is refracted by the refracting recess 611, and this is the low beam mode of the present invention.

Figure 8:
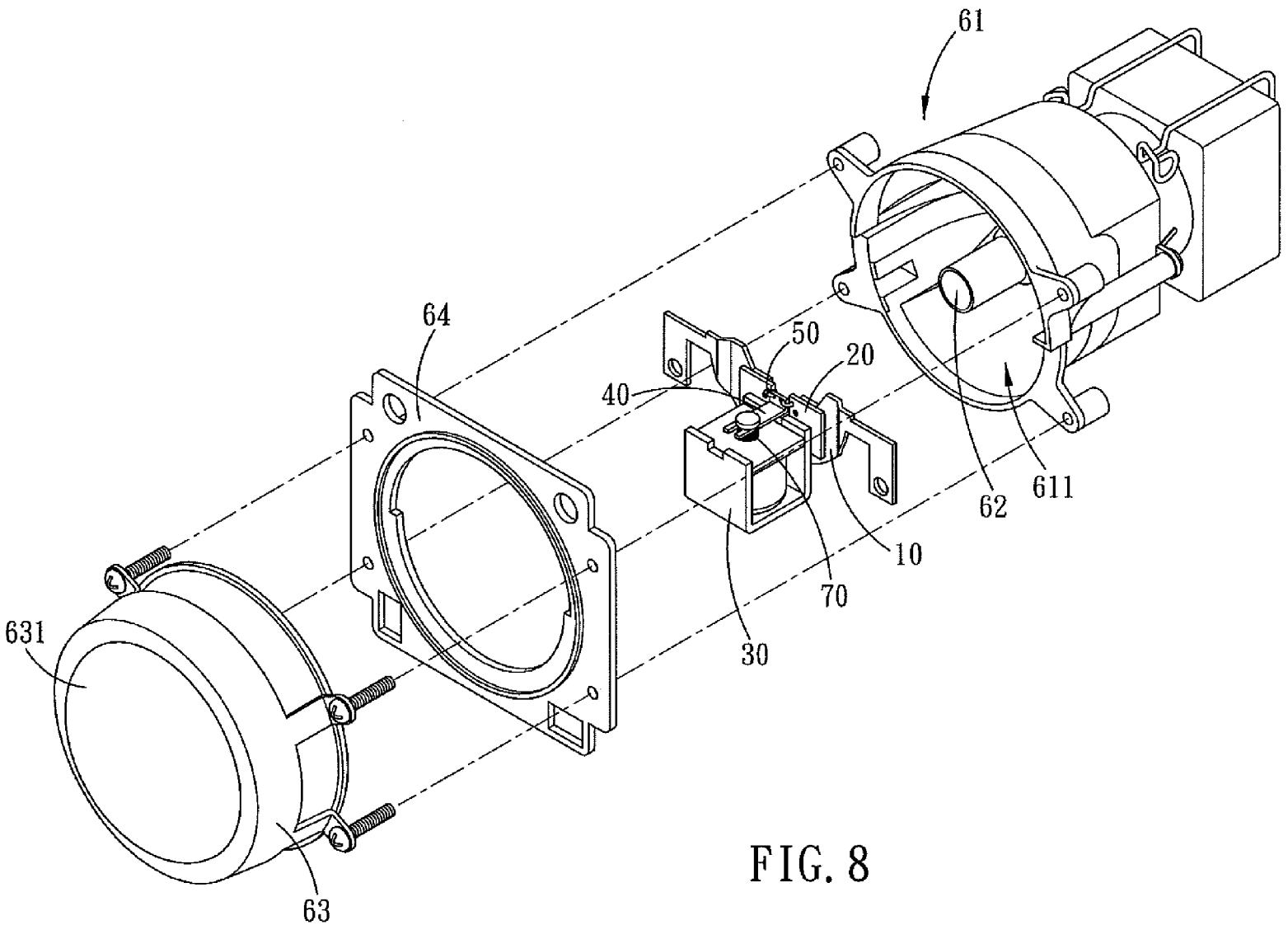
FIG. 8 is an exploded view of a low and high beam switching device for a xenon headlight in accordance with a second embodiment of the present invention.
Figure 9:
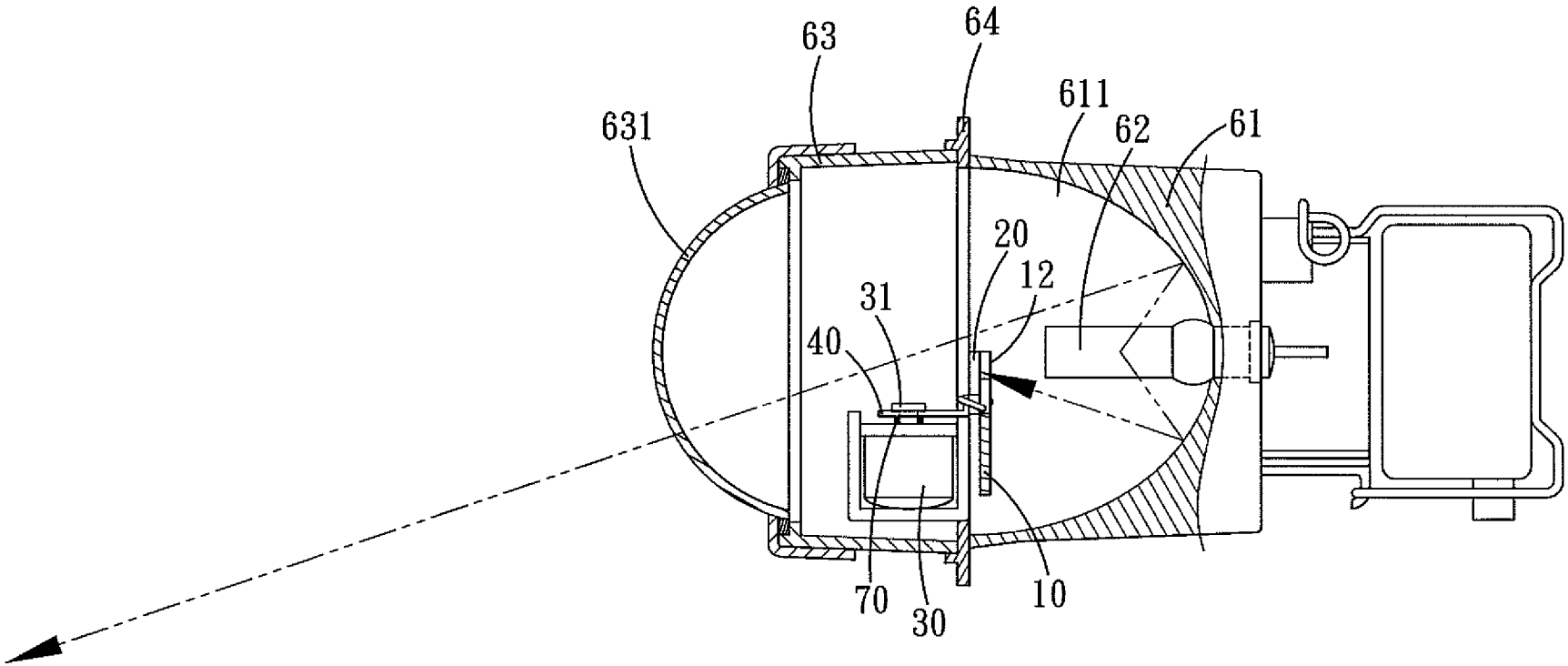
FIG. 9 is an assembly cross sectional view in accordance with the second embodiment of the present invention of showing the high beam mode of the xenon headlight.
Figure 10:
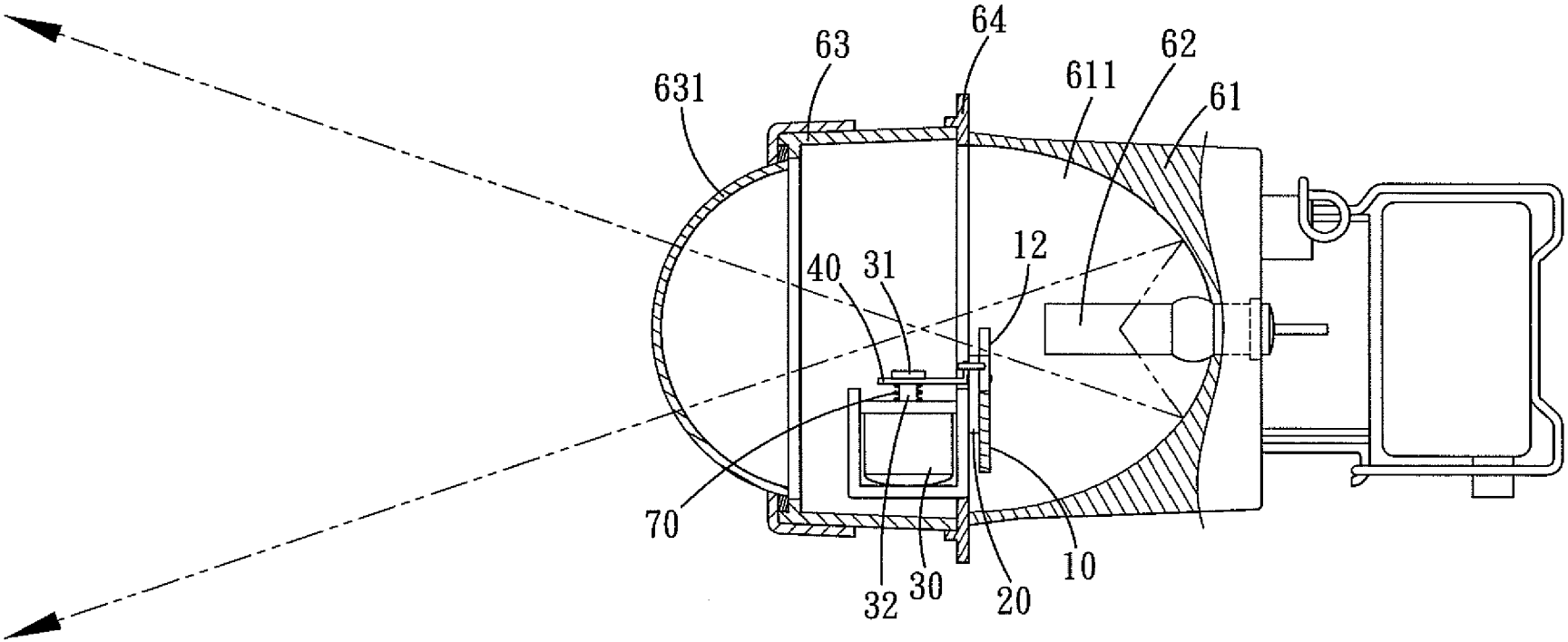
FIG. 10 is an assembly cross sectional view in accordance with the second embodiment of the present invention of showing the low beam mode of the xenon headlight.

In addition, a switching device for switching between low beam mode and high beam mode of a xenon headlight in accordance with a second embodiment of the present invention is shown, and its difference from the first embodiment is that an elastic member is disposed in the neck portion 32 of the lifting rod 31 of the electromagnetic valve 30, and the elastic member is a return spring that can restore its shape after compression. The operation and function of the second embodiment are described as follows, with reference to FIGS. 8-10.

For low beam mode, when the lifting rod 31 of the electromagnetic valve 30 is controlled to move downward, it will compress the elastic member, and the movable piece 40 will move downward along with the lifting rod 31, and the movable piece 40 will use its slide slots 42 to push the retaining rings 50, and then the retaining rings 50 will drive the light-shield pieces 20 to rotate. At this moment, the light-shield pieces 20 open horizontally, and the light-shield portion 22 is located right in the gap 12 of the fixing piece 10. Therefore, the light of the xenon lamp tube 62 will be obstructed by the light-shield pieces 20 and cannot be projected to the distant area when it is refracted by the refracting recess 611, and this is the low beam mode of the present invention.

For high beam mode, when the lifting rod 31 of the electromagnetic valve 30 is controlled to move upward, the compressed elastic member 70 will push the lifting rod 31 to move upward (the elastic member 70 stretches out in the normal state), and the movable piece 40 will move upward along with the lifting rod 31 and push the retaining rings 50, and then the retaining rings 50 will drive the light-shield pieces 20 to rotate away from the gap 12 of the fixing piece 10. At this moment, the light-shield pieces 20 hang down, therefore, the light of the xenon lamp tube 62 won't be obstructed by the light-shield pieces 20 when it is refracted by the refracting recess 611 and projected to the distant area, and this is the high beam mode of the present invention.

The present invention utilizes the elastic member 70 to return the lifting rod 31 of the electromagnetic valve 30 to its original position and to keep the lifting rod 31 in its stretched condition in the normal state, and thus the headlight is in a high beam mode in the normal state.

In addition, the lifting rod can be designed such that both ends of the lifting rod are protruded out of the top and bottom surfaces of the electromagnetic valve, respectively, and the elastic member is mounted on the lower end of the lifting rod protruding out of the bottom surface of the electromagnetic valve, so that, in the normal state, the part of the lifting rod above the top surface of the electromagnetic valve is kept in a compressed condition, and thus the headlight is in a low beam mode in the normal state.

While we have shown and described various embodiments in accordance with the present invention, it is clear to those skilled in the art that further embodiments may be made without departing from the scope of the present invention.

What is claimed is:

1. A switching device for switching between low beam mode and high beam mode of a xenon headlight being disposed between a light holder with a xenon lamp-tube and a transparent lampshade and comprising:

a fixing piece fixed on the light holder, a gap being formed in the fixing piece and located correspondingly to high beam of the xenon lamp-tube;

two light-shield pieces pivotally coupled to the fixing piece and located close to the gap;

an electromagnetic valve fixed on the fixing piece; and a movable piece disposed on the electromagnetic valve pivotally coupled to the light-shield pieces, wherein the movable piece is moved by the electromagnetic valve and then drives the light-shield pieces to rotate to the gap of the fixing piece to obstruct the light beam of the xenon lamp tube, or to rotate away from the gap of the fixing piece.

2. The switching device for switching between low beam mode and high beam mode of a xenon headlight as claimed in claim 1, wherein each of the light-shield pieces includes a pivotal portion and a light-shield portion, the pivotal portion of the light-shield piece is pivotally coupled to the fixing piece by a pivot, when the light-shield pieces are controlled to rotate, the light-shield portion will be located at or away from the gap of the fixing piece.

3. The switching device for switching between low beam mode and high beam mode of a xenon headlight as claimed in claim 2, wherein two horizontal slide slots are in the end of the movable piece that drives the light-shield pieces to rotate, in the pivotal portion of the respective light-shield pieces is formed a through hole, and a retaining ring is disposed in each of the slide slots of the moveable piece and the through hole of the light-shield pieces.

* * * * *